US007434498B2

(12) United States Patent
Johnson

(10) Patent No.: US 7,434,498 B2
(45) Date of Patent: Oct. 14, 2008

(54) TOGGLE-LOCKING TOOL

(76) Inventor: Allen Johnson, 10 Allen Rd., Windham, NH (US) 03087

( * ) Notice: Subject to any disclaimer, the term of this patent is extended or adjusted under 35 U.S.C. 154(b) by 0 days.

(21) Appl. No.: 11/704,062

(22) Filed: Feb. 8, 2007

(65) Prior Publication Data

US 2007/0180957 A1 Aug. 9, 2007

Related U.S. Application Data

(60) Provisional application No. 60/771,492, filed on Feb. 9, 2006.

(51) Int. Cl.
*B25B 7/12* (2006.01)

(52) U.S. Cl. ..... 81/367; 81/382

(58) Field of Classification Search ..... 81/367–384; 269/6

See application file for complete search history.

(56) References Cited

U.S. PATENT DOCUMENTS

| | | | | | |
|---|---|---|---|---|---|
| 1,489,458 | A * | 4/1924 | Petersen | 81/380 |
| 2,280,005 | A | 4/1942 | Petersen | |
| 2,521,276 | A * | 9/1950 | Lampe | 81/372 |
| 2,685,218 | A * | 8/1954 | Burns | 81/372 |
| 2,714,828 | A * | 8/1955 | Britton | 81/380 |
| 3,357,285 | A * | 12/1967 | Adair | 81/93 |
| 3,590,669 | A * | 7/1971 | Marasco | 81/372 |
| 4,044,413 | A * | 8/1977 | Tucker | 7/125 |
| 4,673,174 | A * | 6/1987 | Tabbert | 269/41 |
| 5,143,359 | A * | 9/1992 | Bush | 269/6 |
| 5,377,567 | A | 1/1995 | Sorensen | |
| 5,501,126 | A | 3/1996 | Wright | |
| 5,528,965 | A * | 6/1996 | Finn | 81/356 |
| 6,012,362 | A * | 1/2000 | Wang | 81/368 |
| 6,019,352 | A * | 2/2000 | Mayer | 254/248 |
| 6,175,998 | B1 * | 1/2001 | Leo | 29/268 |
| 7,104,166 | B1 | 9/2006 | Wong | |
| 2004/0055430 | A1 * | 3/2004 | Wong | 81/367 |
| 2005/0279195 | A1 * | 12/2005 | Hile | 81/368 |

* cited by examiner

*Primary Examiner*—D. S Meislin
(74) *Attorney, Agent, or Firm*—Philip Koenig

(57) ABSTRACT

A toggle locking tool is provided with an adjustment screw assembly comprising a force-enhancing shank that enables the holding force of the tool to be multiplied manifold. The adjustment screw assembly comprises an adjustment screw conventionally adapted to be fed into and to engage a threaded bore in the outer end of the fixed handle of the tool; however said adjustment screw itself comprises an internal, fine-threaded bore that extends through the length of said screw, and that receives a threaded force-enhancing shank having a head portion adapted for turning manually or with a turning tool. An end portion of said shank extends beyond the adjustment screw to form the bearing surface which, in a conventional toggle locking tool, is provided by the tip of the adjustment screw. Rotation of the adjustment screw provides rapid, low-force locking adjustment of the tool, and subsequent torquing of the force-enhancing shank results in the application of a multiplied locking force to the jaws of the tool.

17 Claims, 2 Drawing Sheets

TOGGLE-LOCKING TOOL

PRIOR APPLICATION

The present application claims priority from Provisional Application for Pat. No. 60/771,492 filed Feb. 9, 2006.

FIELD OF THE INVENTION

The present invention relates generally to so-called "toggle-locking" tools, which include toggle wrenches, locking pliers, and locking C-clamps. The invention pertains to an improved toggle-locking tool, which comprises a "force-enhancing shank" in the form of a screw that permits the holding power of the tool to be greatly increased following the locking of a work piece in the jaws of the tool.

BACKGROUND

Toggle-locking tools are characterized by an arrangement of four pivots that permits the jaws of the tool to be locked about a work piece. The basic toggle-locking tool was invented by William Petersen and patented in 1924 as U.S. Pat. No. 1,489,458. That original tool, and improvements and variants of that tool made by Petersen and the company he founded, have been sold to the present day under the brand name "Vise Grip". A central objective of all such tools is to combine the function of a vise with that of conventional pliers, enabling a worker to grip a work piece in the tool and then to lock and maintain the grip on the work piece upon releasing the gripping force. A shortcoming of conventional toggle-locking tools is that the holding force by which an object is held in the jaws of the tool is essentially limited by the compression force employed by the user in gripping a work piece, multiplied by such mechanical advantage as is provided by the design of the tool. In particular, this holding force may not readily be increased once the jaws of the tool have been locked about a work piece. Accordingly it is an objective of the present invention to provide a toggle-locking tool comprising means for enhancing the holding force of the tool far beyond the force initially employed to grip an object and to lock the jaws of the tool about that object.

SUMMARY OF THE INVENTION

The present invention achieves its objective of providing a toggle-locking tool having a greatly enhanced holding force by providing a conventional toggle-locking tool with a fine-threaded force-enhancing screw or "shank", fitted in a finely threaded bore within and along the principal axis of an adjustment screw that is otherwise similar to that found in conventional toggle-locking tools. Advancement of the force-enhancing screw, manually or with such additional leverage as may be provided for example by a lever arm or by powered means, enables the holding force of the tool to be multiplied by a large factor.

DETAILED DESCRIPTION OF THE INVENTION

Figure 1:
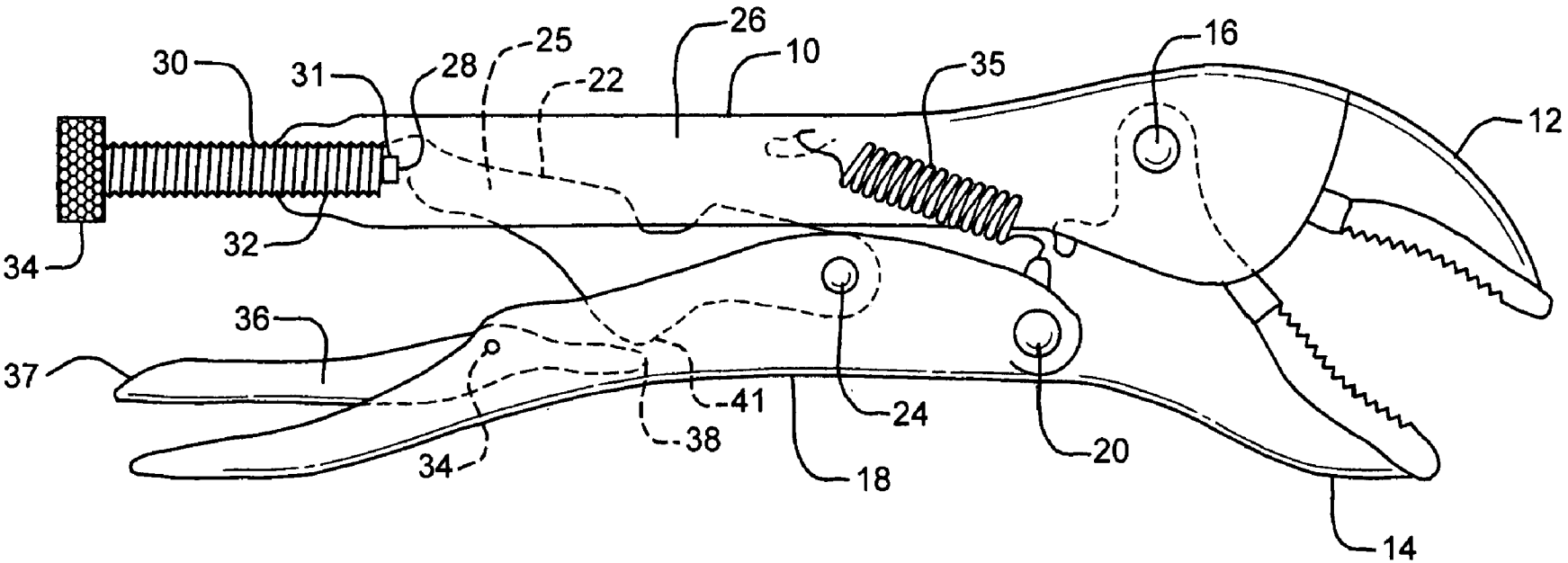
FIG. 1 (PRIOR ART)
FIG. 1 is a side view of a conventional toggle-locking tool of the prior art.

Toggle-locking tools of the prior art employ a four-pivot toggle locking mechanism that generally comprises the following arrangement of parts, as illustrated in FIG. 1: a "fixed" handle 10 is integral with a "fixed" jaw member 12; a movable jaw member 14 is pivotably mounted to the fixed handle at a first pivot point 16, typically positioned near the junction of the fixed jaw member to the fixed handle; a movable handle 18 is pivotably mounted to the movable jaw at a second pivot point 20, some distance below first pivot point 16; and a lever link 22 has one end pivotably mounted to the shaft of the movable handle (at third pivot point 24) and its other end 25 fitted within a channel in the underside of fixed handle 10 and pivotably bearing, at fourth pivot point 28, against the flat or shaped tip 31 of a manually adjustable shank, shown in FIG. 1 as an adjustment screw 30 positioned within a threaded bore 32 at the end of fixed handle 10. Generally, the position of fourth pivot point 28 within channel 26 may be manually adjusted by rotation of adjustment screw 30, for example by manually rotating a knurled knob 34 at the head of screw 30.

In order to bias the jaws of the tool in an open position, and as shown in FIG. 1, a spring 35 is often positioned between fixed handle 10 and a point on movable jaw 14 near second pivot point 20 (between said second pivot point and first pivot point 16). A release lever, such as release lever 36 shown in FIG. 1, the operation of which is described below, is also usually provided; said release lever has a handle 37, opposite a bearing tip 38, and it is pivotably attached to movable handle 18 at a fulcrum 39.

In the operation of a conventional toggle-locking tool as shown in FIG. 1, when the jaws of the tool are closed about a work piece by compression of movable handle 18 against fixed handle 10, and adjustment screw 30 has been so adjusted that its tip 31 contacts the bearing end of lever link 22, lever link 22 is enabled to toggle back and forth between its current "open" position, whereby third pivot point 24 lies below (or "outside") a line drawn between second pivot point 20 and fourth pivot point 28, and a stable "locked" position whereby said third pivot point lies "inside" said line. In particular, when the jaws of the tool have been closed about a work piece, and adjusting screw 30 has been threaded forward until its tip 31 contacts the bearing end of lever link 22, an appreciable compression force on the handles will be required to force lever link 22 "over" from its open position to its "locked" position; and a substantial fraction of this force will remain applied, as a residual force, to hold the work piece within the jaws of the tool even as lever link 22 has settled into its stable "locked" toggle position. At this point the user may release his hands from the tool, and the work piece will remain held within the jaws of the tool by said residual force.

With the tool in locked position about a work piece, a force comparable to that which was applied to "lock" the tool is now necessary to pry open the handles of the tool and release the work piece from its jaws. However release lever 36 has been so positioned that compressing the handle of release lever 36 against movable handle 18, when the tool is locked onto a work piece, causes a force is to be applied with a strong mechanical advantage against a lug 41 in lever link 22, enabling an easy toggling of said lever link back to its "open" position with third pivot point 24 outside the line between second pivot point 20 and fourth pivot point 28.

A conventional toggle-locking tool as described above enables a work piece to be held securely within the jaws of the tool with substantial manual force, possibly in the order of several hundred pounds, depending on the lever multiplication of the basic tool design and the manual strength applied by the user. It has been found, however, that by modifying such a tool in accordance with the invention the holding force of the tool may be greatly enhanced, and in fact multiplied manifold, to such an extent that a holding force in the thousands of pounds is readily achievable.

The present invention of an improved toggle-locking tool employs the observation that the holding force of all such tools is a function of minimizing, for any given work piece, the distance separating the second and the fourth pivot points, by maximizing the insertion of adjusting screw 30, or of any extension of said screw, into the body of fixed handle 10, and against the bearing end of lever link 22. Thus any means that creates a mechanical advantage, once the tool has been locked about a work piece, that permits further advancing the tip of adjusting screw 30, or of any appendage to said screw, against the bearing end of lever link 22, will serve to rapidly and substantially increase the holding force binding the work piece within the jaws of the tool.

A central component employed, in preferred embodiments of the invention, to provide a high mechanical advantage to the application of an enhanced force against the bearing end of lever link 22, is a fine threaded "force-enhancing shank", positioned within and engaging a threaded bore within an otherwise conventional adjustment screw like adjustment screw 30 shown in FIG. 1. Once the basic concept underlying the invention is understood, however, it becomes clear to the person of skill in the art that a variety of means for implementing the invention are available to the worker of skill. Accordingly the detailed description provided below of particular assemblies for achieving the objectives of the invention is intended to be exemplary, and not to limit in any way the forms of comparable force-enhancing assemblies that may be employed in carrying out the invention.

In particular, the type of toggle-locking tool at issue, and the uses to which said tool will be put, will generally determine details of construction. For the simplest toggle-locking tools, it will generally suffice to provide the head portion of the force-enhancing shank with a shape and surface suitable for hand turning, such as a knurled knob, and/or with a geometry adapted to engage a common turning tool such as an ordinary or "phillips" screwdriver. In tools of a comparatively large size, for example, the head portion of a force-enhancing shank may be provided with a transverse bore for receiving a turning bar, thereby greatly increasing the manual leverage that can be applied in turning said force-enhancing shank deeper into the adjustment screw and thus into the handle of the tool, and correspondingly enhancing the force applied against the bearing end of the lever link. Also, the head portion of said force-enhancing shank in a tool according to the present invention may be adapted to engage the drive coupling of an electrically powered turning tool, thereby to drive the rotation of the force-enhancing shank. All of these available means for assisting the turning of a threaded shank are well known in the art and accordingly do not require separate illustration.

In yet other embodiments of the invention, an additional, second force-enhancing shank may be provided, itself positioned within a threaded bore within a first force-enhancing shank, said additional force-enhancing shank having a thread count per inch even higher than that of the first force-enhancing shank. In still yet other embodiments of the invention, assorted gearing means may be linked to a force-enhancing shank, to enable the application of forces with still greater mechanical advantages to the driving of a shank against the bearing tip of the lever link of the tool. These contemplated embodiments of the invention should be sufficiently clear to those of skill in the art to also not require separate illustration.

Figure 2:
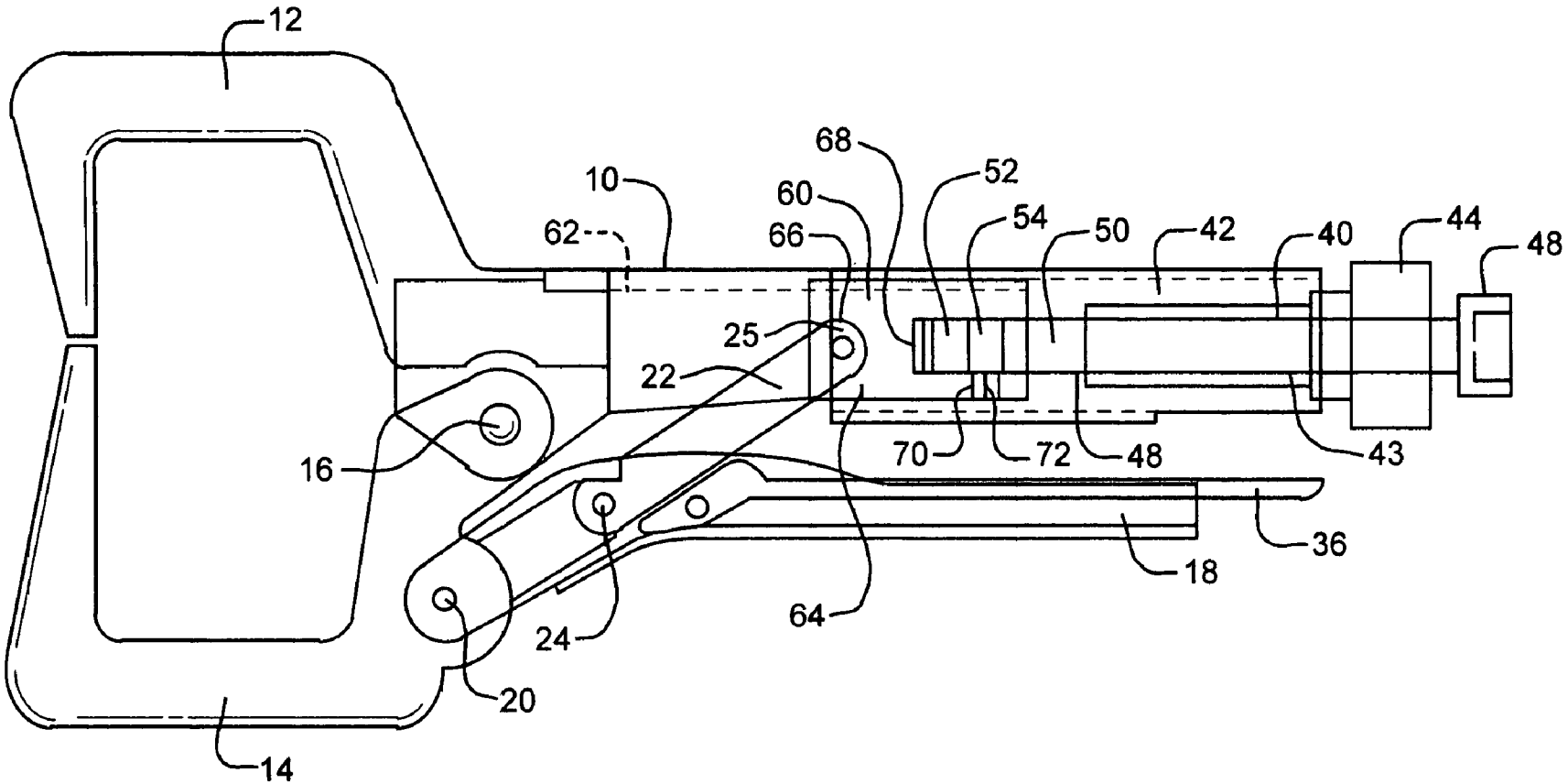
FIG. 2 is a side view of an embodiment of a C clamp toggle-locking tool according to the invention

An exemplary embodiment of the invention is illustrated in FIG. 2. As shown in FIG. 2, an otherwise conventional C clamp toggle-locking tool has been provided with an adjustment screw 40 positioned, as in a conventional tool, in a threaded bore 42 located at the outward end of fixed handle 10, whereby adjustment screw 40 may be advanced or retracted along the main axis of fixed handle 10. Adjustment screw 40 includes a head 44 shaped, as in a conventional toggle-locking tool, as a knurled knob suitable for manually advancing and retracting adjustment screw 40 within bore 42. However, in this embodiment of the invention, adjustment screw 40 does not itself contact the bearing end of linking lever 22. Instead, adjustment screw 40 comprises along its length an internal bore 43, at least a portion of which is finely threaded, for receiving and engaging force-enhancing shank 50. Force-enhancing shank 50 comprises a head portion 46, which extends outwardly outside the head of adjustment screw 40, a finely threaded midsection 48 for engagement with the threaded portion of internal bore 43 of adjustment screw 40, and an unthreaded, cylindrical shank portion 52 having a diameter no greater, and preferably only slightly less than the inner thread diameter of threaded midsection 48. Said shank portion 52 of force-enhancing shank 50 preferably extends well beyond the end of adjustment screw 40; at an intermediate point in said extension of shank portion 52 of shank 50, there is provided a narrow section having a reduced diameter adapted to form a circular channel 54 for receiving and engaging a pin or a yoke.

Importantly, the threads of force-enhancing shank 50 (and the matching threads of the threaded portion of the internal bore 43 within adjustment screw 40) are finer than the external threads of adjustment screw 40. Preferably, the threads per inch count of force-enhancing shank 50 are at least 5 times greater than the threads per inch count of adjustment screw 40. In that way, a five fold mechanical advantage is available for each turn of force-enhancing shank 50, compared to a similar turn of adjustment screw 40, upon the application of an equivalent torquing force.

A bearing block 60 is slidably captured within a channel 62 formed in the underside of fixed handle 10. (Preferably bearing block 60 is made of a material different from that of handle 10, or has been otherwise appropriately processed or treated, to minimize the risk of galling as said bearing slides within channel 62). Bearing block 60 has a solid front portion 64 comprising a concave surface 66 shaped and sized to function as a seat for bearing end 25 of lever link 22. Rear portion 68 of bearing block 60 has an unthreaded internal bore sized to received shank portion 52 of force-enhancing shank 50; intermediate the main axis of said bore, an aperture 70 in bearing block 60, transverse to said bore, is adapted to receive pin 72 and permit said pin to engage circular channel 54 of force-enhancing shank 50 and thereby operatively link bearing block 60 to any advance or retraction of force-enhancing shank 50. (Alternatively, aperture 70 may be shaped to receive a yoke (not shown) adapted to engage said circular channel 54 in force-enhancing shank 50).

The head portion 46 of force-enhancing shank 50 is preferably adapted to engage a suitable lever means for applying a torque to said shank with great mechanical advantage. Various means usable for this purpose (not specifically shown) include: a transverse aperture in head portion 46 for receiving a lever bar, an external hex for engaging a ratchet wrench, an internal hex for receiving a hex key, suitable slots for receiving a hand tool such as an ordinary or a Phillips screwdriver, or a suitable receptacle for linking the head portion 46 of force-enhancing shank 50 to the drive coupling of powered driving means such as an electric drill (not shown).

In the operation of a tool according to the present invention, and with reference to FIG. 2, the tool is closed and locked about a work piece in the conventional manner, by compressing fixed handle 10 and movable handle 18, turning adjustment screw 40 forward as far as is manually possible, and further compressing said handles to achieve a locking action. At this point, force-enhancing shank 50 is turned, using such levering means as are provided for doing so (say, by twisting a lever arm inserted in a transverse aperture in head portion 46 of force-enhancing shank 50), in the direction required to drive said shank inward further into adjustment screw 40 and thus into handle 10. As a result of this action, bearing block 60 drives forward the bearing end 25 of lever link 22, with a force benefiting from great mechanical advantage, and a vastly increased, stable gripping force is applied to the work piece.

In tools embodying the present invention, gripping pressures may readily be achieved, that are vastly greater than the gripping pressures obtainable using conventional toggle-locking tools. It may therefore be necessary to reinforce the tool components to accommodate the greater forces enabled by the invention. In particular it has been found useful to place a support block in the moveable handle of the tool, at a position adapted to support the third pivot point of the tool when in the locked tool position, in order to bear a substantial portion of the additional load subsequently placed upon that pivot point as the force-enhancing shank is driven into the adjustment screw.

Lastly, release of the high gripping pressures enabled by the invention will generally require that the tool be equipped with a suitable release lever capable of high mechanical advantage. The general design of release levers for use with such tools is well known, and therefore need not be described further.

What I claim as my invention is:

1. A tool comprising toggle-locking tool parts including a fixed handle having an outer end comprising a threaded bore adapted to receive an adjustment screw and also having a channel for slidably receiving a bearing end of a lever arm, an upper jaw member integral with the opposite end of said fixed handle, a lower jaw member, a movable handle, and a lever arm having a bearing end, said parts being conventionally arranged with appropriate toggle linkages to form a toggle-locking tool, the improvement consisting of an adjustment screw assembly comprising an adjustment screw, adapted to be fed into and to engage said threaded bore in the outer end of said fixed handle, said adjustment screw itself comprising an internal bore extending through its length and including a fine-threaded portion, and a force-enhancing shank comprising a head portion, a fine-threaded intermediary portion, and an end portion, said shank being adapted to be fed into and threaded within the internal bore of said adjustment screw to a position wherein said end portion of said shank extends beyond said adjustment screw.

2. The tool of claim 1 wherein said adjustment screw assembly further comprises a bearing block disposed within said channel of said fixed handle, said bearing block having a first bearing surface adapted to receive the end portion of said shank and a second bearing surface adapted, upon closing of the tool about an object, to contact said bearing end of said lever arm, whereby any subsequent turning of said shank into said adjustment screw results in a transfer of turning force to said lever arm.

3. The tool of claim 1 wherein the head portion of said shank is knurled and is dimensioned to enable forceful manual turning of the shank.

4. The tool of claim 1 wherein the head portion of said shank comprises a transverse bore for receiving a lever bar.

5. The tool of claim 1 wherein the head portion of said shank has a geometry comprising at least one indentation adapted to engage a manual turning tool.

6. The tool of claim 1 wherein the head portion of said shank comprises an external hex suitable for engaging a ratchet wrench.

7. The tool of claim 1 wherein the head portion of said shank comprises an internal hex suitable for engaging a hex tool.

8. The tool of claim 1 wherein the head portion of said shank comprises means adapted to engage a drive coupling of a powered turning tool.

9. The tool of claim 1 wherein the thread count per unit length of said fine-threaded portion of said shank is higher than the thread count of said threaded bore of said fixed handle.

10. The tool of claim 1 wherein the thread count per unit length of said fine-threaded portion of said shank is at least five times the thread count of said threaded bore of said fixed handle.

11. The tool of claim 2 wherein said fixed handle and said bearing block are made of dissimilar metals to minimize galling between said handle and said block.

12. The tool of claim 2 wherein the end portion of said shank is captured within said bearing block whereby said bearing block moves within said channel of said fixed handle in accord with any movement of said shank along its primary axis.

13. A method for securely but releasably holding an object under high pressure in the jaws of a toggle-locking tool that comprises conventional toggle-locking tool parts including a fixed handle, an upper jaw, a lower jaw, a moveable handle, and a lever arm having a bearing end slidable in a channel of said fixed handle, said parts being joined conventionally by toggle linkages, and that in addition comprises an adjustment screw assembly comprising an adjustment screw, adapted to be fed into and to engage a threaded bore in the outer end of the fixed handle of a said tool, having an internal bore extending through its length and including a fine-threaded portion, and a force-enhancing shank comprising a head portion, a fine-threaded intermediary portion, and an end portion, said shank being adapted to be fed into and threaded within the internal bore of said adjustment screw to a position wherein said end portion of said shank extends beyond said adjustment screw to contact said bearing end of said lever arm directly or through a bearing block, said method comprising the steps of:

(a) adjusting said adjustment screw to a position whereby a said object may be grasped within the jaws of the tool by closing the moveable handle towards the fixed handle;

(b) grasping said object within the jaws of the tool by closing the moveable handle towards the fixed handle with sufficient force to cause the actuation of said toggle linkages and thereby lock said object within said jaws; and (c) rotating the head portion of said shank to thread said shank more deeply within said adjustment screw and thereby enhancing the holding force applied by said jaws to said object.

14. The method of claim 11 wherein the head portion of said shank comprises a transverse slot for receiving a lever bar, and said rotating step comprises inserting a said lever bar in the head portion of said shank and twisting said lever bar to rotate said shank and thread it more deeply into said adjustment screw.

15. The method of claim 11 wherein the head portion of said shank is knurled and is dimensioned and shaped to permit forceful manual turning of said shank as needed to thread it more deeply into said adjustment screw in the course of said rotating step.

16. The method of claim 11 wherein the shank of said tool further comprises a head forming an external hex, and said rotating step comprises attaching a tool to said external hex in the head of said shank and employing said tool to rotate said shank and thread it more deeply into said adjustment screw.

17. The method of claim 11 wherein the shank of said tool further comprises a head comprising means for engaging the drive coupling of a powered turning tool, and said rotating step comprises securing the drive coupling of a powered turning tool to the head of said shank and employing said powered turning tool to rotate said shank and thread it more deeply into said adjustment screw.

* * * * *